US012584284B2

(12) United States Patent
Schupp et al.

(10) Patent No.: US 12,584,284 B2
(45) Date of Patent: Mar. 24, 2026

(54) METHOD OF INSTALLING A FOUNDATION AND A FOUNDATION FOR A STRUCTURE

(71) Applicant: ØRSTED WIND POWER A/S, Fredericia (DK)

(72) Inventors: Jens Schupp, Gentofte (DK); Michael Mygind, Fredericia (DK)

(73) Assignee: Ørsted Wind Power A/S, Fredericia (DK)

( * ) Notice: Subject to any disclaimer, the term of this patent is extended or adjusted under 35 U.S.C. 154(b) by 42 days.

(21) Appl. No.: 18/559,686

(22) PCT Filed: May 9, 2022

(86) PCT No.: PCT/EP2022/062490
§ 371 (c)(1),
(2) Date: Nov. 8, 2023

(87) PCT Pub. No.: WO2022/238332
PCT Pub. Date: Nov. 17, 2022

(65) Prior Publication Data

US 2024/0150989 A1 May 9, 2024

(30) Foreign Application Priority Data

May 11, 2021 (EP) ..... 21173274

(51) Int. Cl.
*E02D 7/24* (2006.01)
*E02B 17/00* (2006.01)
*E02D 7/26* (2006.01)

(52) U.S. Cl.
CPC ..... *E02D 7/24* (2013.01); *E02D 7/26* (2013.01); *E02B 2017/0091* (2013.01)

(58) Field of Classification Search
CPC .... E02D 7/24; E02D 7/20; E02D 7/26; E02B 2017/0091
See application file for complete search history.

(56) References Cited

U.S. PATENT DOCUMENTS 3,763,656 A 10/1973 Verroen et al.
7,891,910 B2 * 2/2011 Schakenda ..... E02D 27/52 405/226

(Continued)

FOREIGN PATENT DOCUMENTS

DE 20208638 U1 9/2002
WO 2010089985 A1 8/2010

OTHER PUBLICATIONS

International Search Report and Written Opinion; International Application No. PCT/EP2022/062490; Orsted Wind Power A/S; dated Sep. 6, 2022.

(Continued)

*Primary Examiner* — Janine M Kreck
(74) *Attorney, Agent, or Firm* — SandBright, PLLC; Robert D. Spendlove

(57) ABSTRACT

Method of installing a foundation (1) having a toe (2) which is inserted into a soil (10) until a depth of the toe (2) reaches at least a minimum installation depth threshold (23). During insertion, fluid is jetted from a plurality of nozzles (7) provided at the toe (2) for directing fluid distally into the soil (10) ahead of the toe (2). The jetting of fluid from the plurality of nozzles (7) is controlled based on the depth of the toe (2), wherein the rate of jetting of fluid is reduced when the depth of the toe (2) reaches a stabilisation depth (22) ahead of the minimum installation depth threshold (23).

10 Claims, 5 Drawing Sheets

(56) References Cited

U.S. PATENT DOCUMENTS

| | | | | |
|---|---|---|---|---|
| 2003/0072620 | A1 | 4/2003 | Long | |
| 2023/0175225 | A1 * | 6/2023 | Schupp | E02D 7/24 405/226 |

OTHER PUBLICATIONS

Second Written Opinion of the International Preliminary Examining Authority; International Application No. PCT/EP2022/062490; Orsted Wind Power A/S; dated Mar. 22, 2023.

International Preliminary Report on Patentability; International Application No. PCT/EP2022/062490; Orsted Wind Power A/S; dated Jul. 21, 2023.

* cited by examiner

METHOD OF INSTALLING A FOUNDATION AND A FOUNDATION FOR A STRUCTURE

CROSS-REFERENCE TO EARLIER APPLICATION

This application is a § 371 National Stage Entry of PCT/EP2022/062490 filed May 9, 2022, entitled "A METHOD OF INSTALLING A FOUNDATION AND A FOUNDATION FOR A STRUCTURE," which application claims priority to EP application Ser. No. 21/173,274.8 filed May 11, 2021. The entire content of these applications is incorporated herein by reference.

The present invention concerns a method of installing a foundation, a foundation for a structure, a controller for use during the installation of a foundation, and software for controlling such a controller. In particular, the present invention concerns structural foundations, such as piles, tubular piles, monopiles, jacket piles, suction bucket/caisson foundations and suction anchors, and skirted foundations that may be inserted into a soil for supporting structures such as buildings, offshore structures, and wind turbines. The present invention is particularly suited to offshore foundations, and more particularly to open ended tubular offshore foundations, and most particularly monopiles and monopiles for wind turbines.

Structural foundations are typically installed by forcing the foundation into the ground. This may be achieved, for example, by applying a weighted ballast to the proximal head of the foundation, applying a vibratory hammer, or using a pile hammer to apply a series of axial impacts to drive the foundation's toe down into the soil. Once installed, the foundation is axially supported by the friction applied to the lateral surfaces of the foundation's body and, to a lesser extent, the resistance to further penetration at the foundation's toe.

During installation, the toe at the distal end of the foundation displaces soil as it is driven down. This compresses the soil in the surrounding region. However, as the foundation is driven deeper, and pressure increases, the forces required to continue displacing soil at the foundation's toe also increase. At the same time, the surface area of the foundation in contact with the soil increases, leading to an increase in the shear forces required to overcome the frictional resistance to driving. As a result, the load bearing capacity of the foundation increases as the foundation is installed deeper into the soil.

In recent years, there has been a trend towards having larger monopile and other foundations, and this has exacerbated the challenges associated with their installation. For example, higher impact forces and/or a higher number of hammer strikes are required for pile driving larger foundations. This in turn imposes significant failure resistance requirements on the foundation. At the same time, the noise generated by the larger impacts is also increased, which presents significant environmental and safety hazards.

In view of the above, various methods and systems have been proposed for making the installation of foundations easier.

In this connection, one solution involves the use of liquid excavation techniques, which not only facilitates easier installation, but may also help to minimise noise emissions. With such arrangements, high pressure nozzles are used to jet liquid for cutting into and flooding the body of soil around the toe in order to fluidise the soil and excavate space for the foundation. With this type of conventional methodology, the soil is removed from its settled positioned in an uncontrolled manner and is suspended in vortices created by the jetted fluid. Once the foundation is in place, the excavated site is then effectively refilled with reclaimed soil. However, as the soil refilling the space is newly located, it has little developed structure and will therefore be inherently weaker as a result. Furthermore, although the newly resettled soil will develop structural strength over time, it can be difficult to verify the load bearing capacity of a newly installed foundation until this strength has developed.

Although conventional jetting methods are effective at aiding the driving of the foundation, this is therefore often to the detriment of the bearing load of the resultant installation. As such, there has been efforts to find alternative solutions. For example, one solution is described in WO2019/206690 where nozzles on the interior of the foundation are used to direct fluid laterally into a soil region displaced inward by the foundation's toe. This thereby allows targeted fluidisation of the soil compressed by the advancing toe, and hence minimises disturbance of the exterior soil structure. However, as this method may not always be suitable, there remains a need for other new methods and systems for reducing installation resistance during installation of a foundation.

According to a first aspect of the present invention, there is provided a method of installing a foundation comprising: inserting the foundation having a toe into a soil until a depth of the toe reaches at least a minimum installation depth threshold; during insertion, jetting fluid from a plurality of nozzles provided at the toe for directing fluid distally into the soil ahead of the toe; and controlling the jetting of fluid from the plurality of nozzles based on the depth of the toe, wherein the rate of jetting of fluid is reduced when the depth of the toe reaches a stabilisation depth ahead of the minimum installation depth threshold.

In this way, during installation, the fluid jetted from the plurality of nozzles may cut into a region of soil distally below the toe for forming a channel into which the foundation may then be received. This may thereby reduce installation resistance during the main driving phase of the foundation's installation. At the same time, by reducing the jetting of fluid in the final phase of installation, the structural integrity of the soil beneath the stabilisation depth is less disrupted. Firstly, this may allow the load bearing capacity of the soil beyond this depth to be more accurately verified. Secondly, this provides a stabilisation region of soil around the distal end of the foundation, extending from the stabilisation depth down to the eventual installed depth of the toe. Accordingly, although the main phase of installation may be facilitated using jetting, which reduces the ballast required to drive the toe, once installation is complete, the region of soil surrounding the distal end of the foundation nevertheless may maintain its structural integrity. This may thereby provide enhanced load bearing capacity. At the same time, the installation resistance of a settled soil structure may be more accurately verified during installation based on measured resistance in the stabilisation region.

In embodiments, the stabilisation depth is 0.5 meter or more shallower than the minimum installation depth threshold. In this way, the stabilisation region of soil may surround at least 0.5 meter at the base of the foundation. In preferred embodiments, the stabilisation depth is 1 meter or more shallower than the minimum installation depth threshold, and most preferably is at least 1.5 meters or more shallower. In embodiments, the stabilisation depth is 10 meters or less shallower than the minimum installation depth threshold. In this way, the toe of the foundation may be driven more easily using jetting during the main phase of installation, with the higher installation resistance associated with the stabilisation region being limited to the last few meters of driving. In preferred embodiments, the stabilisation depth is 7 meters or less shallower than the minimum installation depth threshold, and most preferably is 5 meters or less shallower.

In embodiments, the step of controlling the jetting comprises reducing the rate of jetting of fluid to zero when the depth of the toe reaches the stabilisation depth. In this way, the soil structure within the stabilisation region may be undisturbed by fluidisation.

In embodiments, the step of inserting further comprises inserting the foundation until the installation resistance reaches a minimum installation resistance threshold. In this way, the foundation is inserted until a sufficient load bearing capacity is achieved.

In embodiments, the method further comprises forming a particle trap at an insertion site where the foundation is inserted into the soil for trapping fines particles, the step of forming the particle trap comprising controlling the speed of inserting the foundation during an initial phase and, during the initial phase, jetting fluid from the nozzles to displace soil to form a trench at the insertion site. In this way, a widened trench region may be formed around the foundation at the seabed. Consequently, fines particles excavated by the jetting at the toe and conveyed up in the fluid suspension are expelled into seawater in the particle trap trench region. The relative volume expansion from the fluid channels around the foundation into the trench acts to slow the fines particles, thereby minimising their dispersion into the water above the seabed and effectively trapping them in the trench walls as they settle. In addition to catching fines particles, the particle trap may also catch larger grain fractions. Such larger particles may thereby sink back into the annulus after installation for restoring the in-place stability of the foundation.

In embodiments, the step of jetting of fluid comprises increasing the rate of jetting during the initial phase. In this way, jetting may be used to excavate a depression in the soil at the installation site for forming the particle trap trench.

In embodiments, the step of inserting further comprises applying ballast to the foundation for driving the toe into the soil.

In embodiments, the step of inserting further comprises removing ballast before the depth of the toe reaches a maximum installation depth threshold. In this way, penetration of the foundation may be arrested once the foundation reaches a desired target installation depth window.

In embodiments, the plurality of nozzles provided at the toe comprise an interior array of nozzles distributed around the interior circumference of the foundation and an exterior array of nozzles distributed around the exterior circumference of the foundation, wherein the nozzles are directed in a foundation insertion direction such that the step of jetting fluid through the nozzles forms interior and exterior circumferential cuts in the soil ahead of the toe. In this way, the nozzles are arranged in two concentric arrays, which during use, may form corresponding circular channels in the soil ahead of the toe, inline with the interior and exterior walls of the foundation. As such, the fluid is focussed on cutting into the soil ahead of the lateral surfaces of the foundation, thereby reducing penetration resistance without excessive fluidisation of the soil.

In embodiments, interior and exterior circumferential cuts are for separating soil from interior and exterior lateral surfaces of the foundation, respectively.

According to a second aspect of the present invention, there is provided a foundation, comprising: a toe for insertion into a soil; a plurality of nozzles provided at the toe for jetting fluid distally into the soil ahead of the toe when the toe is inserted into the soil, wherein the plurality of nozzles comprise an interior array of nozzles distributed around the interior circumference of the foundation and an exterior array of nozzles distributed around the exterior circumference of the foundation, and wherein the nozzles are directed in a foundation insertion direction such that the interior and exterior arrays respectively form interior and exterior circumferential cuts in the soil ahead of the toe when fluid is jetted through the nozzles during insertion.

In embodiments, the toe comprises a manifold for receiving high pressure fluid and having an interior facing lateral face and an exterior facing lateral face, and wherein the interior and exterior arrays of nozzles are provided on a plurality of nozzle heads that project from the interior and exterior facing lateral faces of the manifold, respectively. In this way, a relatively large cross-sectional area for supplying fluid may be provided within the manifold, thereby reducing pressure losses and minimising the number of feeder-pipes connections required. For example, the manifold may be fed by a single feeder pipe.

According to a third aspect of the present invention, there is provided a controller for controlling the installation of a foundation, the foundation comprising a toe for insertion into a soil until a depth of the toe reaches at least a minimum installation depth threshold, the controller comprising: a toe depth calculator for determining the current depth of the toe; and a jetting control for controlling the jetting of fluid from a plurality of nozzles provided at the toe for directing fluid distally into the soil ahead of the toe, wherein the controller controls the jetting based on the depth of the toe, and the rate of jetting is reduced when the depth of the toe reaches a stabilisation depth ahead of the minimum installation depth threshold.

According to a fourth aspect of the present invention, there is provided software for operating a controller for controlling the installation of a foundation, the foundation comprising a toe for insertion into a soil until a depth of the toe reaches at least a minimum installation depth threshold, the software comprising: instructions for determining the current depth of the toe; and instructions for controlling the jetting of fluid from a plurality of nozzles provided at the toe for directing fluid distally into the soil ahead of the toe, wherein jetting is controlled based on the depth of the toe and the rate of jetting is reduced when the depth of the toe reaches a stabilisation depth ahead of the minimum installation depth threshold.

Illustrative embodiments of the present invention will now be described with reference to the accompanying drawings in which:

FIG. 1 shows a foundation 1 according to an embodiment of the invention. In this embodiment, the foundation 1 is a monopile for installation in an offshore location for supporting a wind turbine.

The foundation 1 comprises a hollow tubular body having an exterior lateral surface, and an interior lateral surface that defines an interior cavity in the form of a bore. In this example, the foundation 1 is provided with a conical section toward its proximal end. The distal part of the foundation 1 comprises a toe 2 for insertion into the soil at the sea bed.

Figure 1:
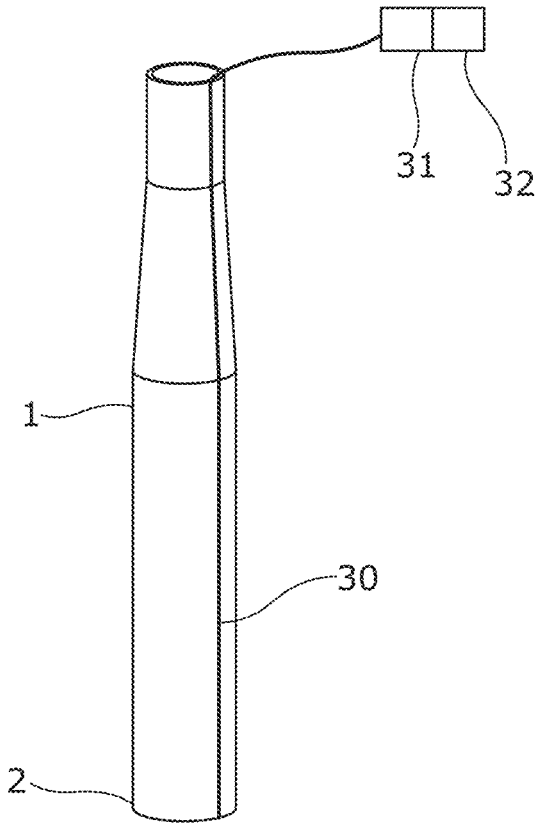
FIG. 1 shows a view of a monopile foundation according to a first embodiment of the invention.
Figure 2:
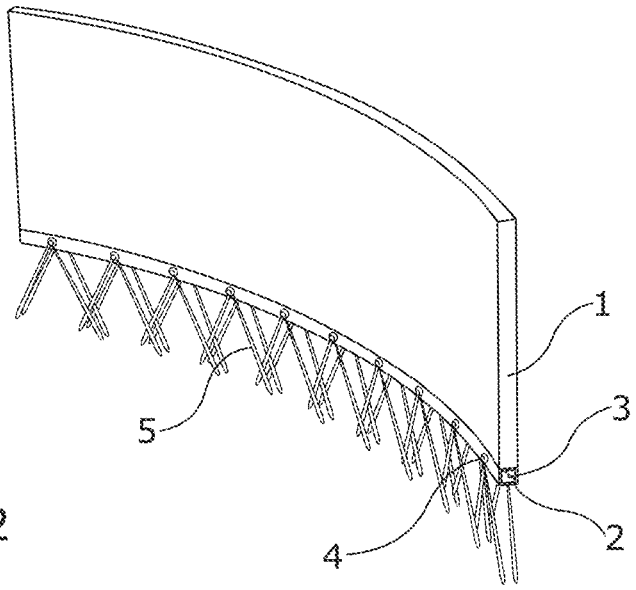
FIG. 2 shows an isometric sectional view of the toe of the foundation shown in FIG. 1.
Figure 3:
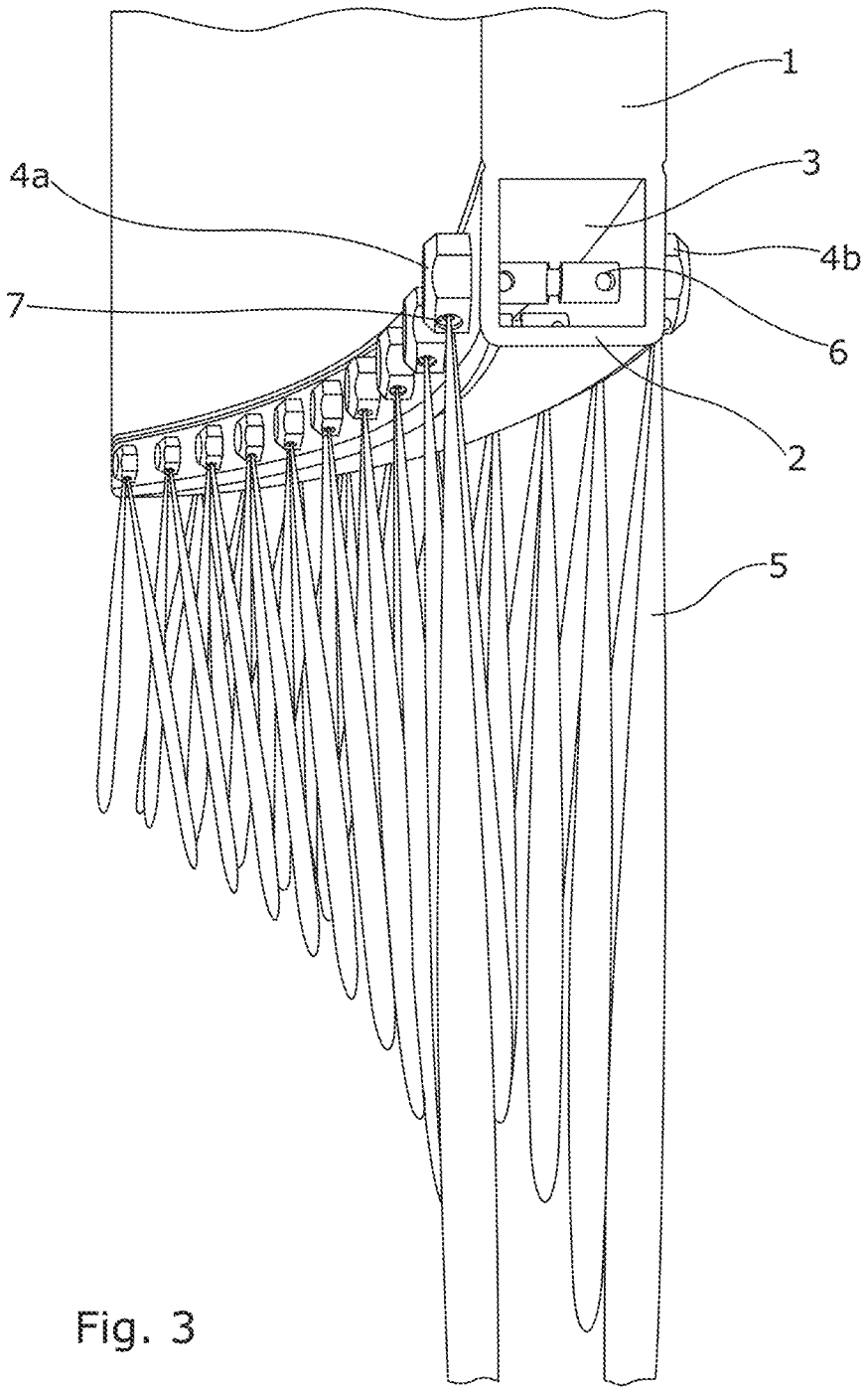
FIG. 3 shows an enlarged isometric sectional view of the toe of the foundation shown in FIG. 1.
Figure 4:
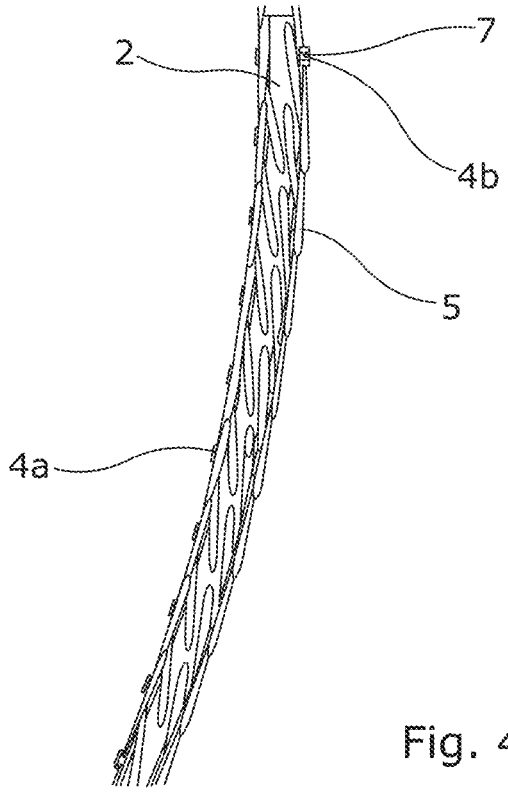
FIG. 4 shows a bottom view of a section of the toe of the foundation shown in FIG. 1.
Figure 5:
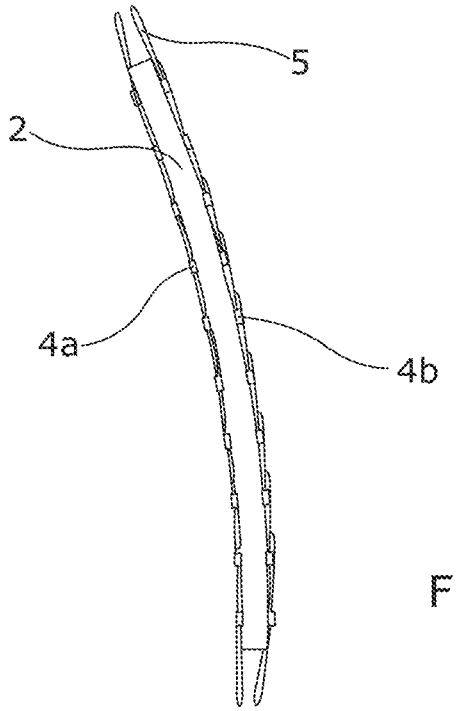
FIG. 5 shows a top view of a section of the toe of the foundation shown in FIG. 1.

As shown in FIGS. 2 to 6, in this embodiment, the toe 2 of the foundation is provided with a manifold 3 which forms a ring like conduit around the aperture defining the opening into the interior cavity of the foundation 1. In use, the manifold 3 is pressurised by fluid fed through the fluid feed pipe 30 provided on the exterior of the foundation body, as shown in FIG. 1. In other embodiments, one or more fluid feed pipes may be used, and these may be secured to the exterior or interior surface of the foundation 1, or through the body of the foundation itself. The fluid feed pipe 30 is fed by a fluid pump 31 under the control of controller 32 provided on the installation vessel, another vessel or any other appropriate place. The pressurisation of the manifold 3 by fluid during use may help to resist its compression if, for example, the toe 2 is driven into a rock in soil during installation.

The manifold 3 feeds two arrays of nozzle heads 4, with a first array 4*a* arranged around the interior edge of the toe 2 and the second array 4*b* arranged around the exterior edge of the toe 2. Each nozzle head 4 comprises two nozzles 7 for directing pressurised fluid jets 5 downwardly in a fanned configuration. The arrangement of nozzle heads 4*a*,4*b* is shown more clearly in the bottom and top views of FIGS. 4 and 5, respectively. As shown, the cutting action of the jets 5 from adjacent nozzles 7 in the same row of nozzle heads 4*a*,4*b* overlap to form circumferential cuts into the soil ahead of the toe 2. Accordingly, an interior circumferential cut is created by the first array of nozzle heads 4*a*, and an exterior circumferential cut is created by the second array of nozzle heads 4*b*.

Figure 6:
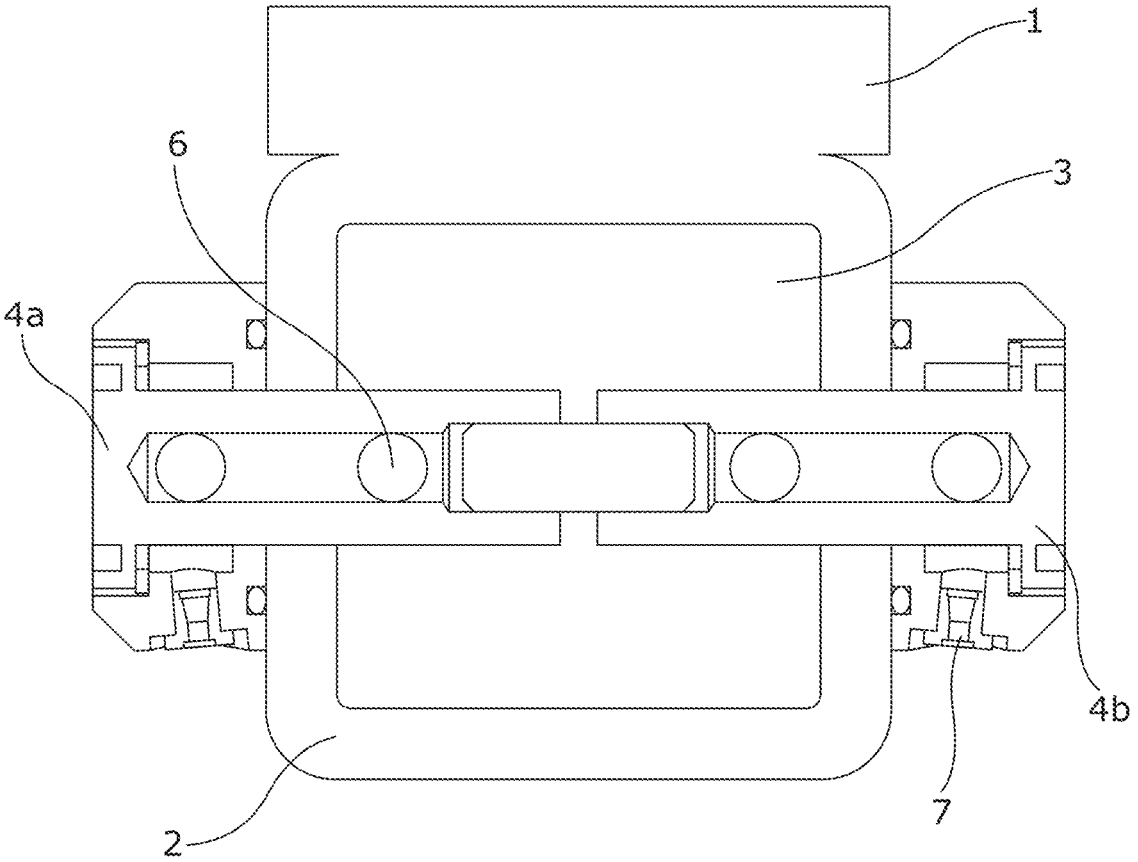
FIG. 6 shows a cross-sectional view of the toe of the foundation shown in FIG. 1.

Turning to FIG. 6, the nozzles 7 of the heads 4 are fed by their connectors 6, which extend into the interior conduit of the manifold 3, and contain an internal fluid channel between the nozzles 7 and the manifold 3. As such, fluid fed into the manifold 3 is jetted through the nozzles 7.

Figure 7:
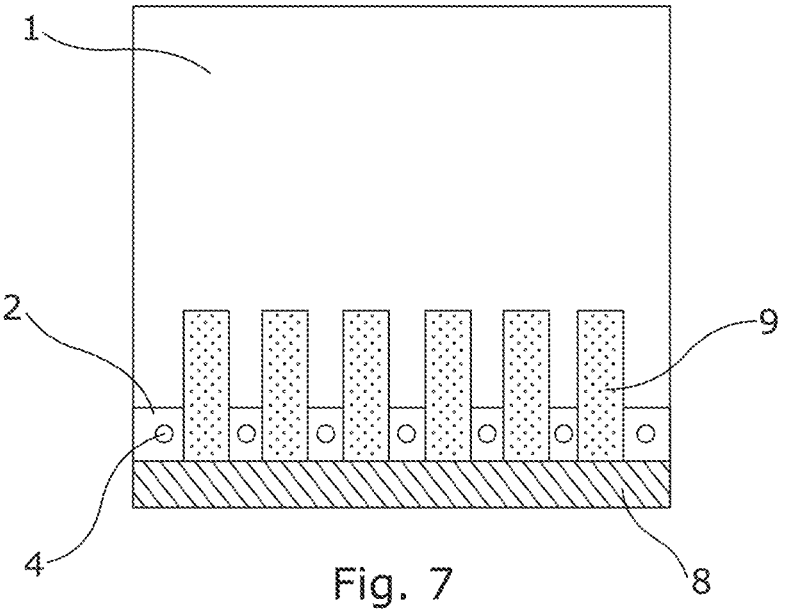
FIG. 7 shows a schematic bottom view of the toe of the foundation received within an upending tool.

FIG. 7 shows a plan view of the exterior surface of the toe 2 of the foundation 1, when received within the base of an upending tool 8. A plurality of support plates 9 are fitted to the outer surface of the pile 1 between the gaps in the nozzle heads 4. In embodiments, the support plates 9 are 20-40 mm thick and sized so that their width may support the foundation 1 between the gaps in the nozzle heads 4, without interfering with the jets. In embodiments, the support plates 9 are welded to the exterior surface of the foundation 1 to axially reinforce the manifold 2. Support plates 9 may also be provided on the interior surface of the foundation 1.

During deployment, the foundation 1 is fitted into the upending tool 8 from a secured horizontal position on an installation vessel. The heads 4 are protected by the support plates 9 so that they are not damaged during the upending operation. The foundation 1 is then tilted up into a vertical orientation, pivoting about the upending tool 8, from where it can be lifted by a crane down to the seabed.

Figure 8:
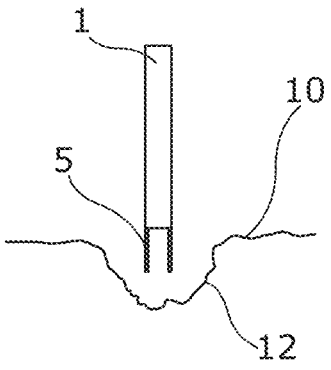
FIGS. 8 to 10 show a sequence of schematic illustrations of the foundation being installed.
Figure 9:
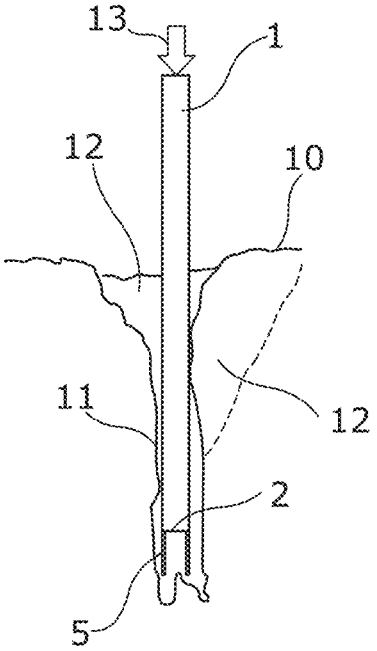
Figure 10:
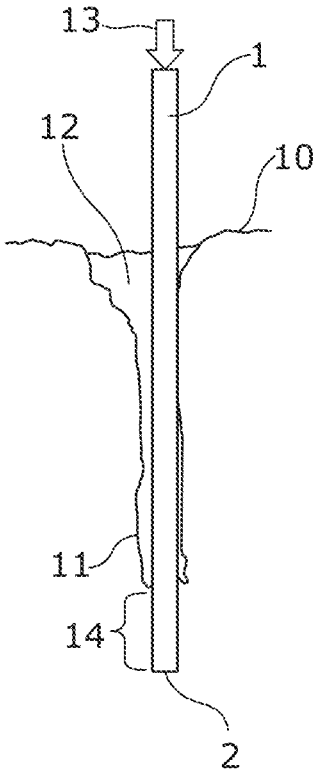

FIGS. 8 to 10 show a sequence of the foundation 1 being installed according to an embodiment of the invention. In FIG. 8, the foundation 1 is slowly lowered to the soil 10 on the seabed. The controller 32, as shown in FIG. 1, controls the pump 31 to generate fluid jets 5 through the nozzles 7 as the toe 2 approaches the seabed. This has the effect of forming a wide particle trap trench 12 around the circumference of the foundation 1.

Once the particle trap trench 12 is formed, the toe 2 of the foundation 11 is lowered to an insertion site at the base of the particle trap trench 12. The foundation is lowered further, causing its toe 2 to be driven downward into the soil 10 under the foundation's own weight. This insertion is further facilitated by the jetting 5 from the nozzles 7.

As shown in FIG. 9, the jets 5 act to cut into the soil 10 ahead of the toe as the foundation 1 continues down, thereby forming a deep trench 11 from the base of the particle trap trench region 12. The deep trench 11 extends from the jetted region ahead of the toe 2 up to the particle trap trench region 12 at the seabed. Depending on the installation resistance exhibited by the soil, ballast 13 may be applied to the top of the foundation 1 to keep the toe 2 advancing down. Toe depth and installation resistance are determined by the controller 32 based on how far the foundation 1 has been driven into the soil 10 and the rate of its advance.

Depending on the soil properties, the trench 11 may exhibit different characteristics. The left side of FIG. 9 shows a low resistance situation where the fluid suspension pressure acts to stabilise the trench wall. This allows a thin fluid channel to be maintained over the lateral surfaces of the foundation 1, thereby minimising installation resistance. Conversely, the right side of FIG. 9 shows a high resistance situation where the trench wall collapses back onto the lateral surfaces of the foundation 1, resulting in active earth pressure increasing the installation resistance. In practice, it will be understood that the soil characteristics may vary through the depth, and the foundation 1 may be subjected to both low and high resistance regions.

As the toe 2 advances, fines particles excavated from the soil region ahead of the toe are suspended in the fluid, and are conveyed up the fluid channels formed between the deep trench 11 and the lateral surfaces of the foundation 1. As the soil suspension reaches the particle trap trench region 12, the expansion of fluid volume as the trench widens acts to slow the flow of fluid. This acts to trap particles in the particle trap trench 12, thereby minimising their expulsion into the surrounding seawater.

Once the toe 2 reaches a predetermined depth before the installation depth, the controller 32 turns off or reduces the jetting 5. As such, the soil 10 ahead of the toe 2 is less fluidised, which results in an increase in installation resistance. The toe 2 is nevertheless driven further by the ballast 13, until it reaches a target installation depth, as shown in FIG. 10.

The predetermined depth defines the starting point of a stabilisation region 14 of soil 10 ahead of the target installation depth. Depending on the soil, the threshold for starting the stabilisation region 14 may be 1 to 5 metres ahead of the target installation depth. As such, the foundation 1 may be driven relatively quickly using jetting assistance through the main phase of installation, with the slower driving speeds associated using minimal jetting assistance or ballast only driving being limited to the final phase of installation.

While the toe 2 is advancing through the stabilisation region 14 during the final phase of installation, the controller 32 may use the measured installation resistance to more accurately estimate the ultimate axial load bearing capacity of the foundation. That is, as the stabilised region of soil around the distal end of the foundation is less fluidised, it may be used to validate the axial capacity of the foundation.

Figure 11:
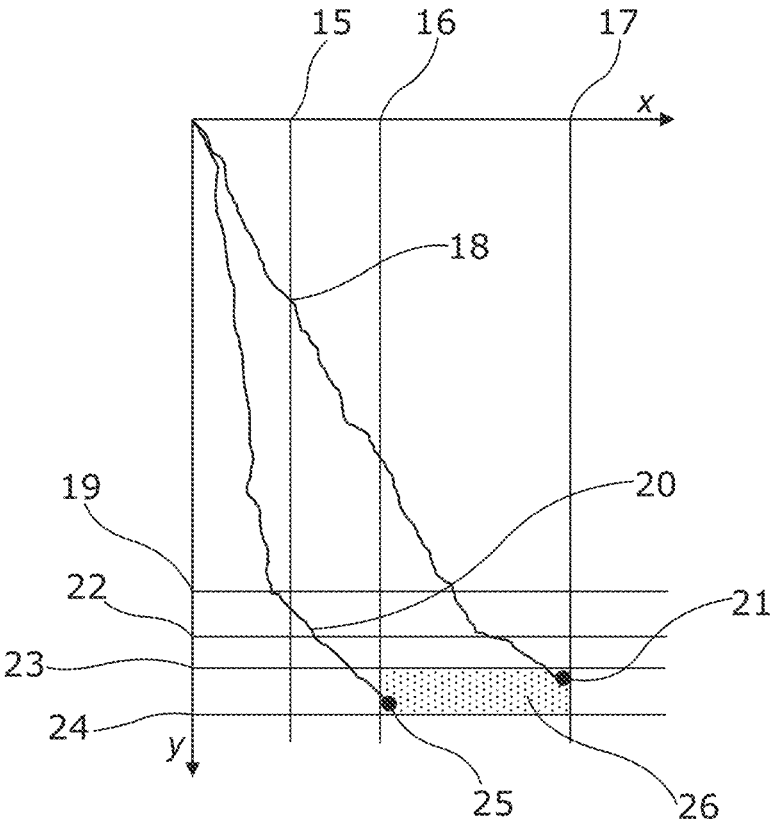
FIG. 11 shows a graph plotting installation resistance against installation depth during two illustrative use case examples.

FIG. 11 shows a graph plotting installation resistance (x axis) against toe installation depth (y axis) during a low resistance scenario 20 and a high resistance scenario 18.

In both scenarios, the toe 2 progresses downward under the self-weight of the foundation 1 up until the self-weight threshold 15, albeit that in the low resistance scenario 20, the toe 2 will have reached a much deeper depth.

In the low resistance scenario 20, the controller 32 may apply a shallower depth stabilisation threshold 19, to provide a larger stabilisation region 14. As such, once the shallower depth stabilisation threshold 19 is reached, the jetting rate may be reduced to a lower rate. This results in an increased installation resistance, and a slower rate of descent. Ballast 13 may be applied until the toe of the foundation 1 exceeds the minimum installation depth threshold 23 and the measured installation resistance exceeds the minimum installation resistance threshold 16, to thereby validate the required axial capacity. This is shown by point 25 on the graph. Once reached, the ballast 13 is removed before the toe 2 exceeds the maximum installation depth threshold 24, which could otherwise cause the foundation 1 to be installed too deep, outside of its design tolerances.

In the high resistance scenario 18, the ballast 13 is applied at a relatively shallow installation depth in order to maintain advancement of the toe 2. In this case, the minimum installation resistance threshold 16 is exceeded well before the minimum installation depth threshold 23 is reached. Consequently, the main driving phase continues with jetted assisted insertion until the controller 32 determines that a deeper depth stabilisation threshold 22 has been reached. At this stage, the fluid jetting is turned off, resulting again in an increased installation resistance, and a slower rate of descent. Ballast 13 is applied until the foundation 1 achieves the minimum installation depth threshold 23. At the same time, the ballast 13 is removed before the installation resistance threshold 17 is exceeded. That is, installation will continue until a target penetration depth between the minimum and maximum installation depth thresholds is reached, or until the available down force from the ballast 13 and the foundation's self-weight is exhausted. Thereafter, the ballast 13 will be removed.

As will be understood, in both the low resistance and high resistance scenarios, the foundation is inserted into the soil until it reaches a desired target installation window 26 that exists between the minimum and maximum installation resistance thresholds 16,17 and the minimum and maximum installation depth thresholds 23,24. Furthermore, although the stabilisation region 14 in the high resistance scenario will be much shorter than the low resistance scenario, this is compensated by the inherently higher strength soil.

After installation, the surplus water will drain away from the trench 11, and soil particles will resettle. Over time, the resettled soil will compact through cyclic shake down effects, thereby restabilising the soil.

It will be appreciated that with the above methods and arrangements, a foundation may be installed into the soil more easily using the jetted assisted installation. This reduces cost and allows installation noise to be minimised. At the same time, a higher load bearing capacity may be achieved by maintaining the structural integrity of the soil beneath the stabilisation depth.

It will be understood that the embodiments illustrated above show applications of the invention only for the purposes of illustration. In practice the invention may be applied to many different configurations, the detailed embodiments being straightforward for those skilled in the art to implement.

For example, the above-described control method may be applied to other jetting arrangements. For instance, the control method may be applied to foundations having a single array of downward nozzles.

It will also be understood that additional mechanisms and systems may be used in combination with the fluid jetting system for further reducing driving resistance. For instance, the foundation may further incorporate electrodes for electro-osmosis. As such, the fluid jetting system may work synergistically with the electro-osmosis system. Furthermore, in other arrangements, further upward facing jets may be provided on the foundation body for reducing resistance and resisting trench wall collapse.

The invention claimed is:

1. A method of installing a foundation (1) for a wind turbine comprising:

inserting the foundation (1) having a toe (2) into a soil (10) and measuring installation resistance, wherein the foundation (1) is inserted until a depth of the toe (2) reaches at least a minimum installation depth threshold (23), and until the installation resistance reaches at least a minimum installation resistance threshold (16);

during insertion, jetting fluid from a plurality of nozzles (7) provided at the toe (2) for directing fluid distally into the soil (10) ahead of the toe (2); and controlling the jetting of fluid from the plurality of nozzles (7) based on the depth of the toe (2), wherein the rate of jetting of fluid is reduced when the depth of the toe (2) reaches a stabilisation depth (22) ahead of the minimum installation depth threshold.

2. A method according to claim 1, wherein the stabilisation depth (22) is 0.5 meter or more shallower than the minimum installation depth threshold (23).

3. A method according to claim 1, wherein the stabilisation depth (22) is 10 meters or less shallower than the minimum installation depth threshold (23).

4. A method according to claim 1, wherein the step of controlling the jetting comprises reducing the rate of jetting of fluid to zero when the depth of the toe (2) reaches the stabilisation depth (22).

5. A method according to claim 1, further comprising forming a particle trap (12) at an insertion site where the foundation is inserted into the soil (10) for trapping fines particles, the step of forming the particle trap (12) comprising controlling the speed of inserting the foundation (1) during an initial phase and, during the initial phase, jetting fluid from the nozzles (7) to displace soil (10) to form a trench at the insertion site.

6. A method according to claim 5, wherein the step of jetting of fluid comprises increasing the rate of jetting during the initial phase.

7. A method according to claim 1, wherein the step of inserting further comprises applying ballast (13) to the foundation (1) for driving the toe (2) into the soil (10).

8. A method according to claim 7, wherein the step of inserting further comprises removing ballast (13) before the depth of the toe (2) reaches a maximum installation depth threshold (24).

9. A method according to claim 1, wherein the plurality of nozzles (7) provided at the toe (2) comprise a interior array of nozzles (4*a*) distributed around the interior circumference of the foundation (1) and an exterior array of nozzles (4*b*) distributed around the exterior circumference of the foundation (1), wherein the nozzles (7) are directed in a foundation insertion direction such that the step of jetting fluid through the nozzles (7) forms interior and exterior circumferential cuts in the soil (10) ahead of the toe (23).

10. A method according to claim 9, wherein the interior and exterior circumferential cuts are for separating soil (10) from interior and exterior lateral surfaces of the foundation (1), respectively.

* * * * *